US005758670A

United States Patent [19]

Ogunro

[11] Patent Number: 5,758,670

[45] Date of Patent: Jun. 2, 1998

[54] HAIR BRAIDING APPARATUS AND METHOD

[76] Inventor: E. Olayinka Ogunro, 2727 Bolton Boone, #105, DeSoto, Tex. 75115

[21] Appl. No.: 683,627

[22] Filed: Jul. 17, 1996

[51] Int. Cl.[6] ..... A45D 7/00

[52] U.S. Cl. ..... 132/210; 132/226; 87/8; 87/13; 87/33; 87/62

[58] Field of Search ..... 132/200, 210, 132/226, 245, 249, 250, 333; 87/8, 13, 25, 33, 62

[56] References Cited

U.S. PATENT DOCUMENTS

| | | | |
|---|---|---|---|
| 592,049 | 10/1897 | Fischhaber | 132/245 |
| 619,805 | 2/1899 | Thompson | 132/249 |
| 850,553 | 4/1907 | West | 132/248 |
| 4,038,996 | 8/1977 | Eronini et al. . | |
| 4,307,737 | 12/1981 | Shipman | 87/25 |
| 4,369,690 | 1/1983 | Sapkus . | |
| 4,580,585 | 4/1986 | Sapkus . | |
| 4,583,561 | 4/1986 | Larsson . | |
| 5,119,847 | 6/1992 | Powell et al. . | |

FOREIGN PATENT DOCUMENTS

| | | | |
|---|---|---|---|
| 19127 | 2/1905 | Austria | 132/245 |
| 8081 | 4/1907 | United Kingdom | 132/245 |

*Primary Examiner*—Todd E. Manahan
*Assistant Examiner*—E. Robert
*Attorney, Agent, or Firm*—John A. Thomas

[57] ABSTRACT

A hair braiding apparatus is disclosed comprising a U-shaped rod having a left arm and a right arm, the arms offset from one another relative to the plane of the U shape, a guide for holding a first strand of hair and a second strand of hair in alignment with the left arm and the right arm, respectively, and a clamp for holding the first and second strands of hair in slideable engagement with the left and right arms of the rod respectively. Methods of braiding with embodiments of the invention are disclosed. One or more of the strands may be artificial hair. A method of braiding natural hair with artificial hair using the braiding apparatus is also disclosed.

17 Claims, 9 Drawing Sheets

HAIR BRAIDING APPARATUS AND METHOD

BACKGROUND

This invention relates to hair braiding apparatus, and more particularly to hand-operated hair braiding apparatus which braids natural hair and weaves artificial hair into braids of natural hair.

Hair braiding is an ancient art. Even today it is usually practiced by hand. Some modern hair styles rely on weaving small braids over the entire scalp and thus require considerable time and labor. The prior art discloses many inventions directed to mechanizing the task of braiding hair. Generally these are complex machines intended to completely mechanize the task of braiding. Such machines will be complicated to manufacture, and thus relatively expensive in the retail hair-care market. The present invention is intended to solve this problem by partially mechanizing the task of braiding hair. The present invention allows the human braider to work faster and more accurately than by hand, yet it is simple to manufacture and operate. It may be used to braid natural hair, or to weave strands of artificial hair into natural hair. Further, the apparatus may be safely used by young children to braid hair, including doll hair.

SUMMARY

The foregoing and other objects of the invention are accomplished by providing a hair braiding apparatus having means for grasping two strands of hair, and a means allowing the operator to rapidly interchange the positions of the two strands with respect to a third strand, so as to interlace the three strands into a braid. In the same manner, one or more of the strands may be artificial hair. A method of braiding natural hair with artificial hair using the braiding apparatus is also disclosed.

DRAWINGS

DETAILED DESCRIPTION

Figure 2:
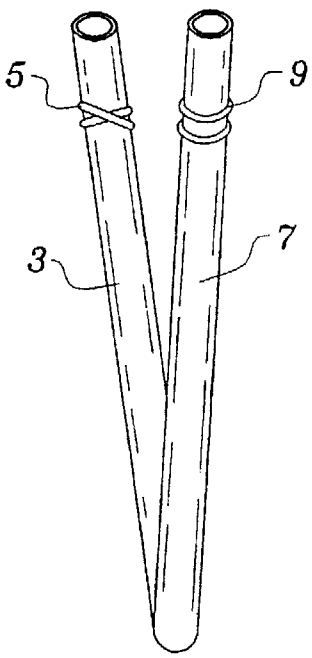
FIG. 2 is a side view of the preferred embodiment, showing an offset between its two arms.
Figure 1:
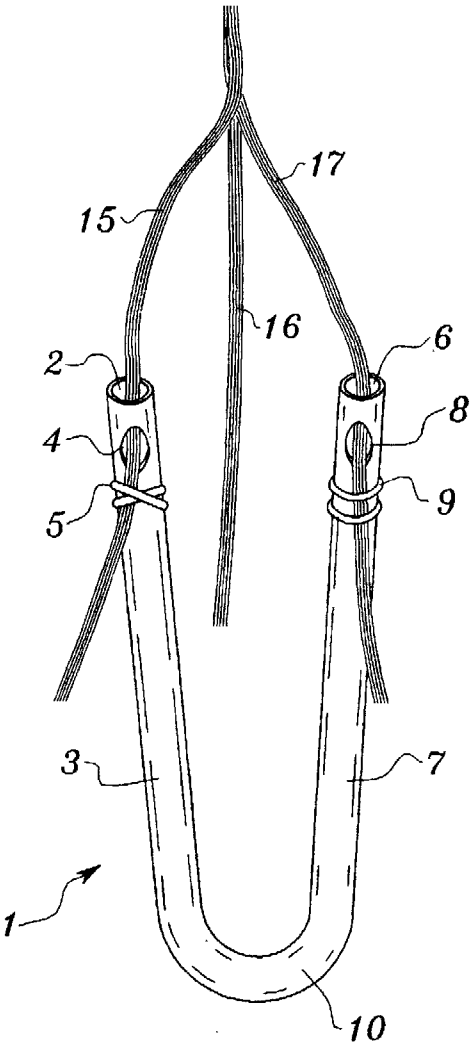
FIG. 1 shows the preferred embodiment of the invention, and three strands of hair, in the first cycle of the braiding process.
Figure 4:
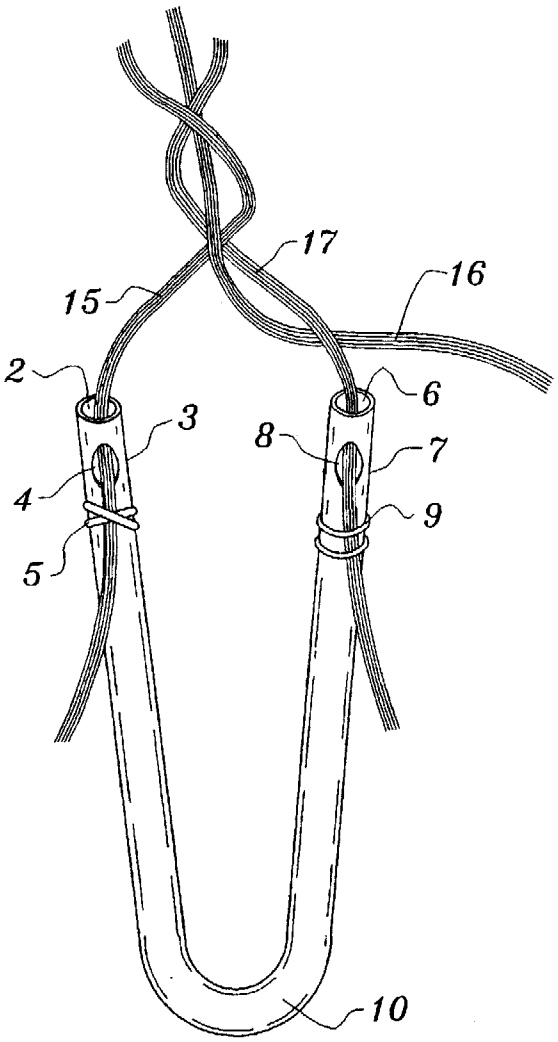
FIG. 4 shows the preferred embodiment in the third stage of the braiding cycle.

The preferred embodiment of the braiding apparatus 1 shown in FIGS. 1 through 4 is a rod formed in the shape of a U. The rod has two arms, 3 and 7, called left and right respectively, for purposes of the following description. The bottom of the U shape forms a base 10. The base 10 is flexible and resilient, allowing the arms 3 and 7 to cross and uncross as described below. Instead of the flexible and resilient base 10, the base 10 could be provided with a pivot 53 and a spring 52 urging the arms 3 and 7 apart. FIG. 2 shows the two arms 3 and 7 slightly offset from one another in the plane formed by the U shape.

Figure 8:
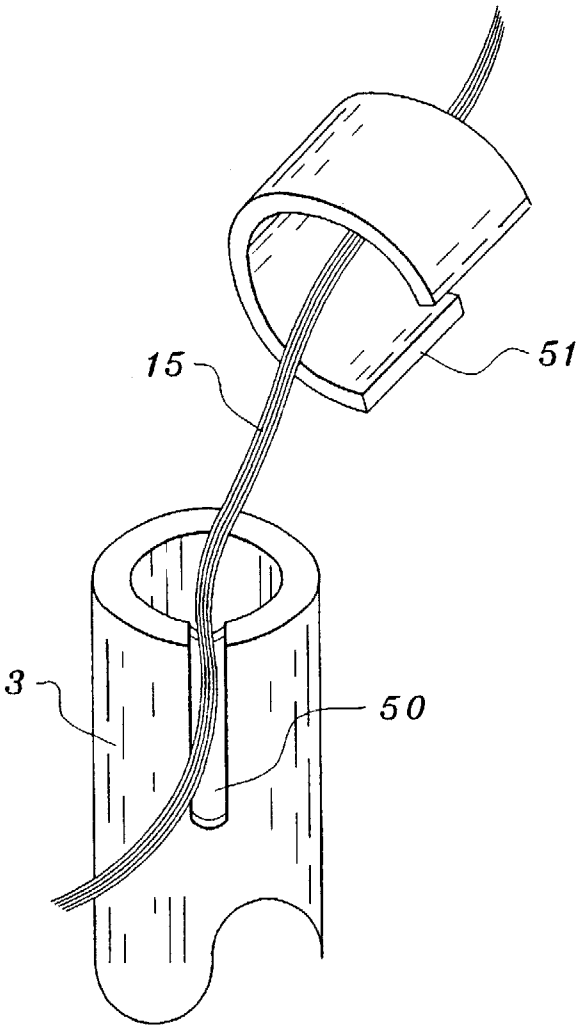
FIG. 8 shows an alternate embodiment of the means for guiding strands of hair through the arms of the braiding apparatus.

First, the hair to be braided is separated into three strands, 15, 16, and 17. Strand 15 is to the left of the person braiding, strand 17 is to the right of the person braiding, and middle strand 16 is disposed between strands 15 and 17. Strand 15 is threaded through a inlet hole 2 and outlet hole 4 in the left arm 3 of the braiding apparatus, and strand 17 is threaded through a inlet hole 6 and a outlet hole 8 in the right arm of the braiding apparatus. Holes 2 and 4 in arm 3 communicate with each other to form a passage for the strand of hair. Holes 6 and 8 in arm 7 communicate in a like manner. These holes guide the strands of hair 15 and 17 and hold them in alignment with the arms 3 and 7 of the braiding apparatus 1. The guiding means for the strands of hair may also be provided by a groove 50 in each of the arms 3 and 7, so that the strands of hair may be laid into the respective grooves 50, and held therein by a removable clip 51, as shown in FIG. 8. The clip 51 grasps an arm 3 or 7 by spring pressure, and may be turned to close or open a groove 50. In other respects, the various embodiments of the invention described below function in the same manner.

Each strand 15 and 17 is passed under the clamp means 5 and 9 disposed on the respective arms 3 and 7. In the embodiment shown, the clamp means are elastic bands wrapped around the arms 3 and 7, but the clamp means could be any device which grips the hair strands 15 and 17 and holds each hair strand in firm but slideable engagement with the respective arms 3 and 7. Suitable clamp means include elastic bands, spring clips or adjustable screw clamps. The clamp means are adjusted to allow the hair to be released as the braid is formed, while still providing sufficient tension on the hair strands to maintain the tightness of the braid.

Figure 3:
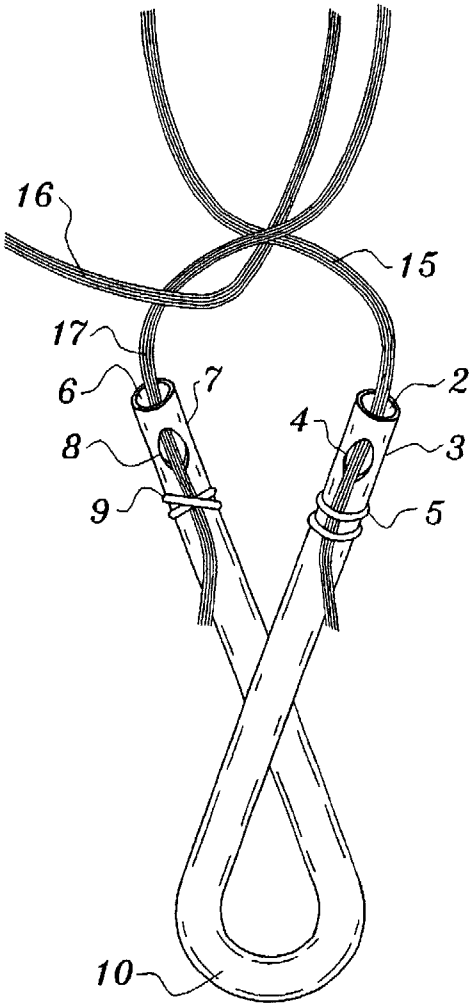
FIG. 3 show the preferred embodiment in the second stage of the braiding cycle.

The strands 15 and 17 are pulled through the left and right arms 3 and 7 until about 2.5 cm (1 inch) of hair is available between the braiding apparatus 1 and the head of the person whose hair is to be braided. The arms 3 and 7 are squeezed by the operator so that the arms 3 and 7 cross and exchange positions, moving the strands 15 and 17 with them, as shown in FIG. 3. The middle strand 16 is then grasped by the operator and pulled upward through the opening defined by the arms 3 and 7 and strands 15 and 17, to cross strand 17, as shown in FIG. 3.

The middle strand 16 is next held downward across strand 17, and the arms 3 and 7 are allowed to uncross. This forms the first crossing of the braid. Next, the braiding apparatus is pushed upward slightly. The middle strand 16 is then grasped by the operator and pulled downward through the opening defined by the arms 3 and 7 and the strands 15 and 17. The arms 3 and 7 of the braiding apparatus are then crossed, forming the second crossing of the braid. The braiding apparatus 1 is then again pushed downward slightly. The middle strand 16 is pulled upward from below the braiding apparatus 1, and the braiding apparatus 1 is uncrossed, forming the third crossing of the braid. The braiding apparatus 1 and the strands are now in the same relative positions as at the beginning of this detailed description, ready for another cycle of braiding. As braid advances, the operator allows the strands 15 and 17 to slide through the clamp means 5 and 9, while keeping tension on the advancing braid.

The tightness of the braid is increased by holding the middle strand 16 firmly and increasing the tension of the left and right strands 15 and 17. The braid is made looser by holding the middle strand 16 loosely and decreasing the tension of the left and right strands 15 and 17.

Figure 6:
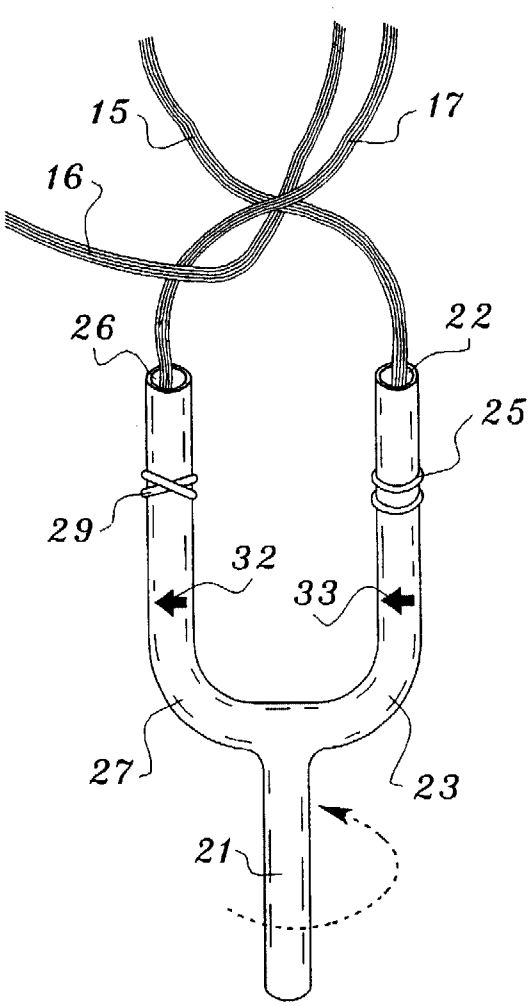
FIGS. 5 through 7 show an alternate embodiment of the invention.
Figure 5:
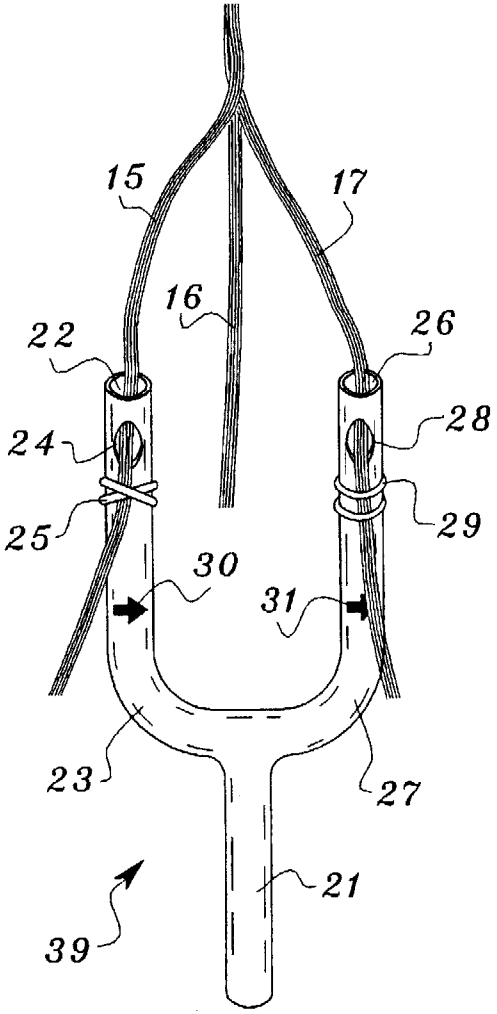
Figure 7:
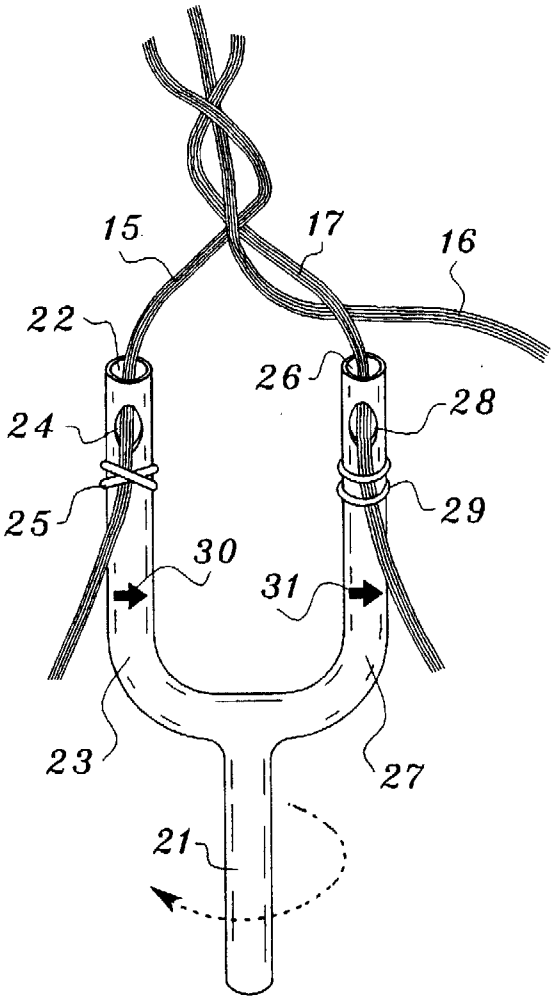

Another embodiment of the invention is shown in FIGS. 5 through 7. The principle of operation is the same as that of the previously described embodiment, except that the crossing and uncrossing of left and right strands 15 and 17 is achieved by rotating the braiding apparatus 39 about the axis of its handle 21 180 degrees in a predetermined direction, and then reversing the rotation. As shown in FIG. 5, this embodiment of the invention has left and right arms 23 and 27 forming the upright portions of a U-shaped member. The base of the U is attached to the handle 21. Similar to the previous embodiment, each arm 23 and 27 has two holes in each arm, shown as 22 and 24, and 26 and 28, respectively. Inlet hole 22 and outlet hole 24 communicate with each other to form a passage for the strand of hair. Inlet hole 26 and outlet hole 28 communicate in a like manner.

Each strand 15 and 17 is passed under the clamp means 25 and 29, on the respective arms 23 and 27. Again, the clamp means shown are elastic bands wrapped around the arms 23 and 27, but the clamp means could be any device which grips the hair strands 15 and 17 and holds each strand in firm but slideable engagement with the respective arms 23 and 27.

The braiding apparatus shown in FIGS. 5 through 7 is used in the same manner as the previously-described embodiment, except that the crossing of the strands 15 and 17 is accomplished by rotating the braiding apparatus 39 about the axis of the handle 21 180 degrees in a predetermined direction and then reversing this rotation, as indicated in the sequence shown in FIGS. 6 and 7. It is preferred that the arms 23 and 27 be marked with direction indicators 30 and 31, on one side of the arms 23 and 27, and direction indicators 32 and 33 in the opposite sense on the other side of the arms 23 and 27 to assist the user; the direction indicators 30 and 31, and 32 and 33, showing the user the direction of the next turn of the handle in each braiding cycle.

The present invention can be also be used to weave artificial hair with natural hair, in order to add body or to lengthen natural hair. Either of the two embodiments described above may be used. The method will be illustrated using the first embodiment of the braiding apparatus 1 described above, the U-shaped rod having a flexing and resilient base 10. However, the method will be the same if the second embodiment described above shown in FIGS. 5 through 7 is used, and the following descriptions are intended to encompass both embodiments, as well as embodiments having a groove 50 and clip 51 to guide the strands of hair. Also, the term "natural hair" in the following descriptions refers to hair growing from the head of the subject whose hair is to be braided, and the term "artificial hair" refers to any filaments intended to be braided with natural hair, and may include actual human hair.

Figure 10:
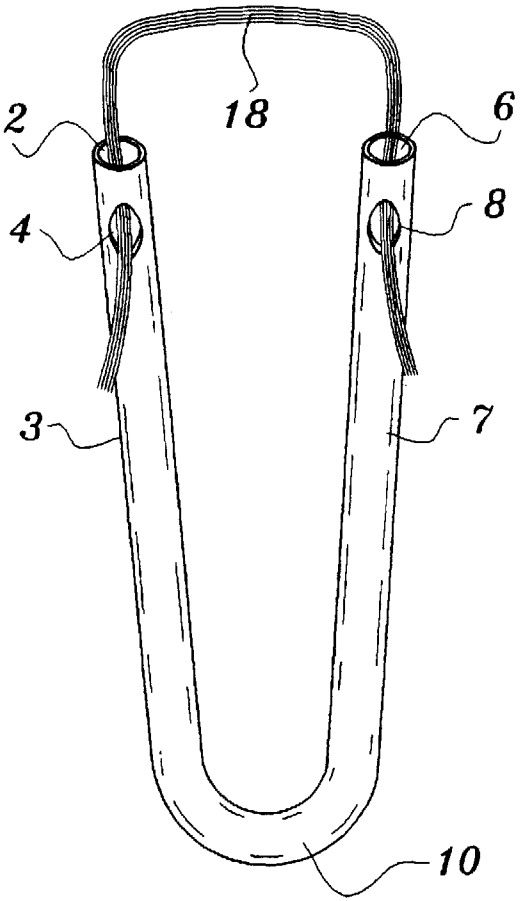
FIGS. 9 through 14 show the preferred embodiment in the sequential steps of braiding a strand of artificial hair with a strand of natural hair.
Figure 9:
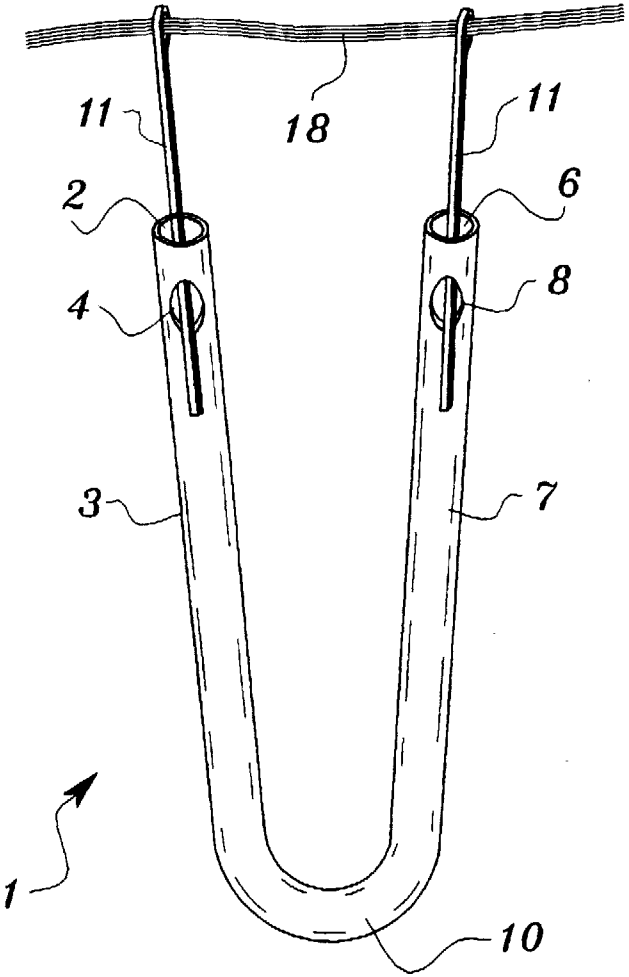
Figure 12:
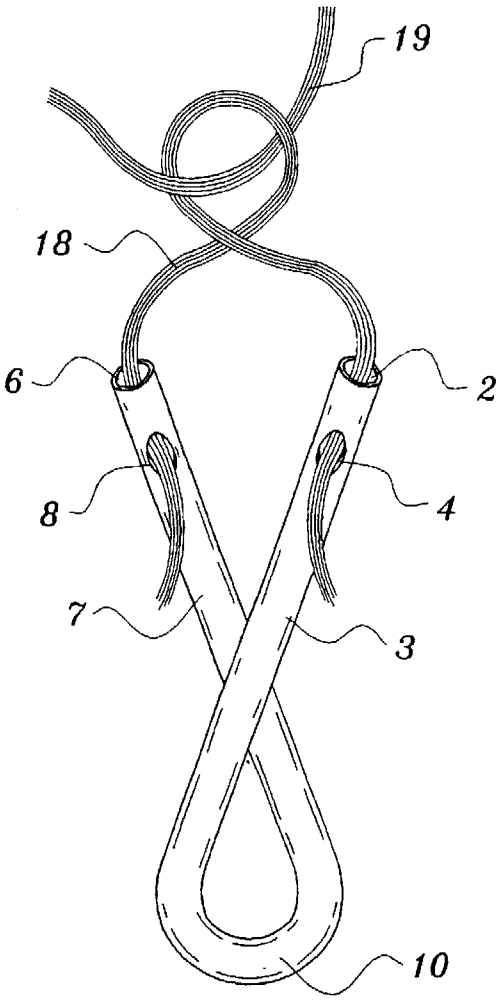
Figure 11:
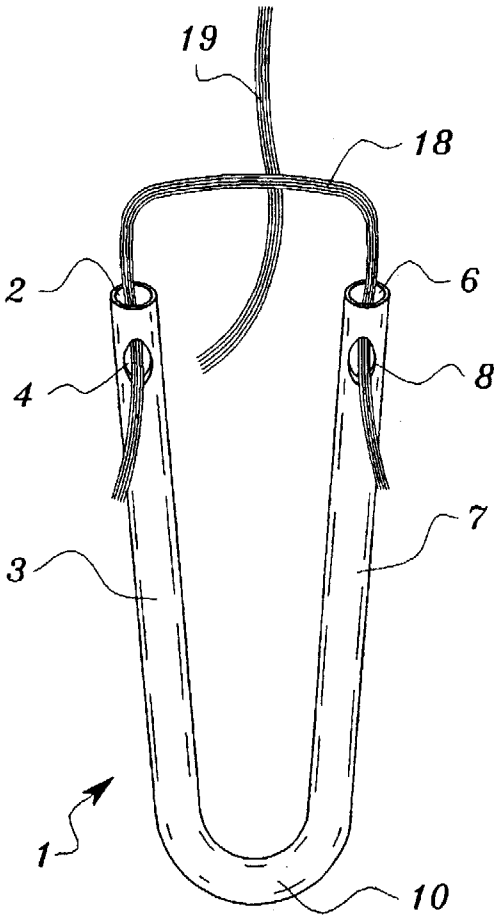

FIG. 9 shows a strand of artificial hair 18 disposed above the arms 3 and 7 of a braiding apparatus 1. The artificial hair 18 is grasped by conventional hair pins 11 and pulled through the holes 2 and 4, and 6 and 8, in the left and right arms 3 and 7, respectively. The strand of artificial hair 18 is held in slideable engagement with the arms 3 and 7 by clamp means 5 and 9 as before, as shown in FIG. 10. Next, a strand of natural hair 19 is pulled upwardly through the opening formed by the strand of artificial hair 18 and the braiding apparatus 1, as shown in FIG. 11. The left and right parts of the strand of artificial hair 18 and the strand of natural hair 19 now constitute the three strands necessary for forming a braid. The arms of the braiding apparatus 1 are next crossed, forming a loop in the strand of artificial hair 18 about the strand of natural hair 19 as shown in FIG. 12. The braiding apparatus is held in this position and pushed upward slightly. The middle strand 19 is then grasped by the operator and pulled upward to cross strand 18 inside the opening defined by the left and right portions of strand 18, and the arms 3 and 7, as shown in FIG. 13.

Figure 13:
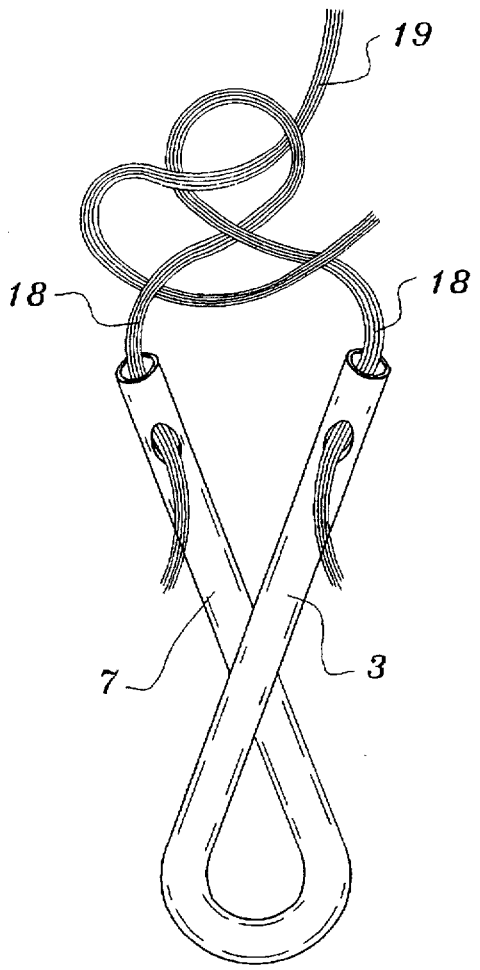
Figure 14:
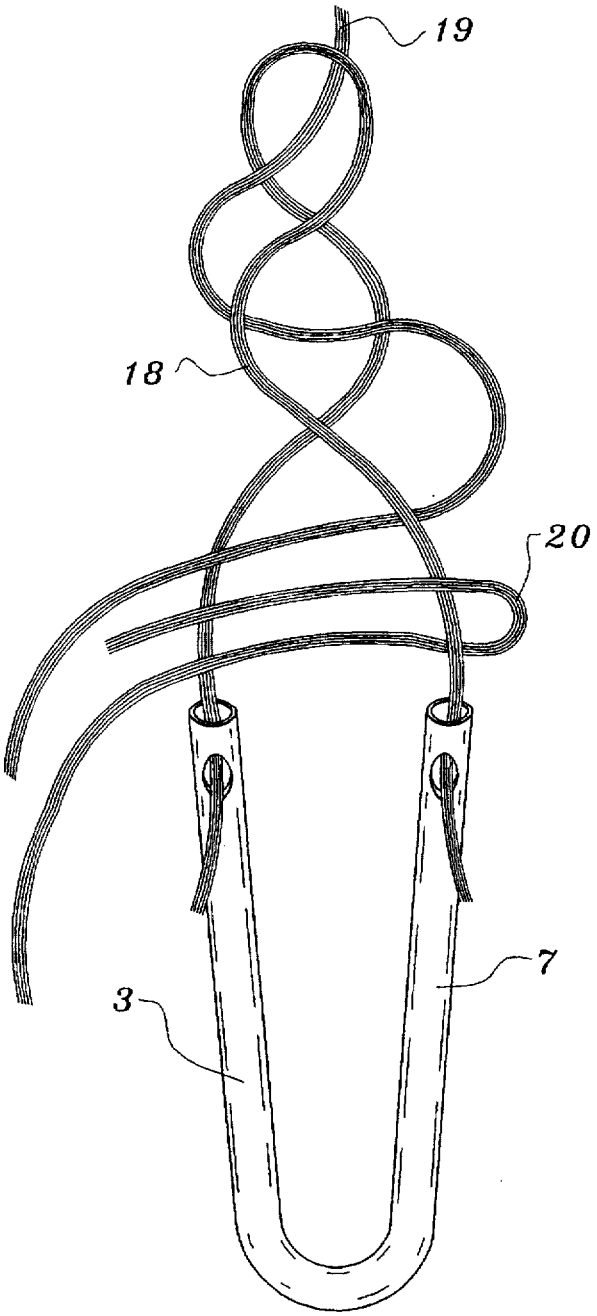

The middle strand 19 is then pulled downward across the rightmost strand 18 as shown in FIG. 13, and the arms 3 and 7 are allowed to uncross. This forms the first crossing of the braid. Next, the braiding apparatus is pushed downward slightly. The middle strand 19 is then grasped by the operator and pulled upward through the opening defined by arms 3 and 7, and the left and right portions of strand 18, as shown in FIG. 14.

At this point, braiding proceeds as previously described. FIG. 14 also shows an additional strand of artificial hair, 20, which may, if desired, be inserted into the braid to join strand 19, both strands 19 and 20 then constituting the middle strand of the braid. As the braid advances, the operator allows the strands formed from the artificial hair strand 18 to slide through the clamp means 5 and 9 while maintaining tension on the advancing braid.

Figure 15:
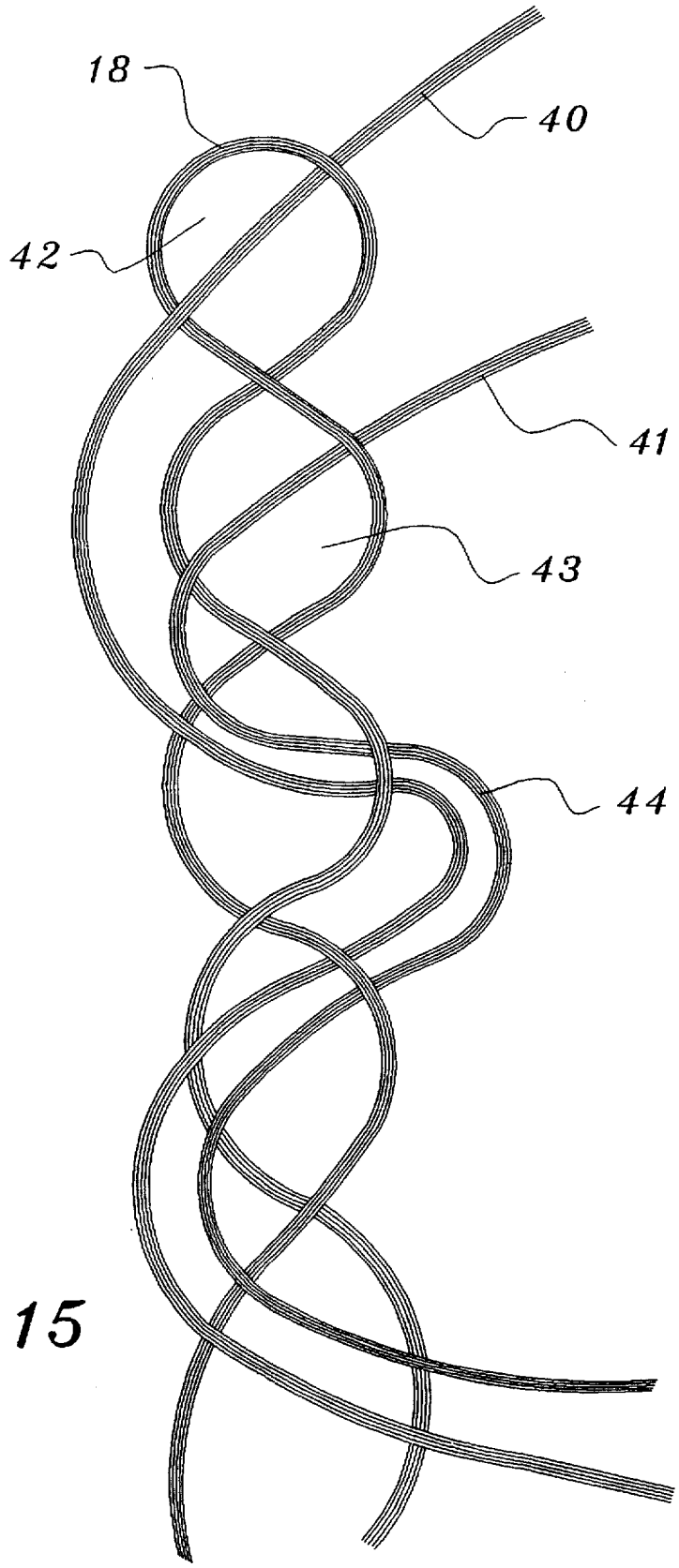
FIG. 15 shows a method of locking a strand of artificial hair with two strands of natural hair, using the preferred embodiment.
Figure 16:
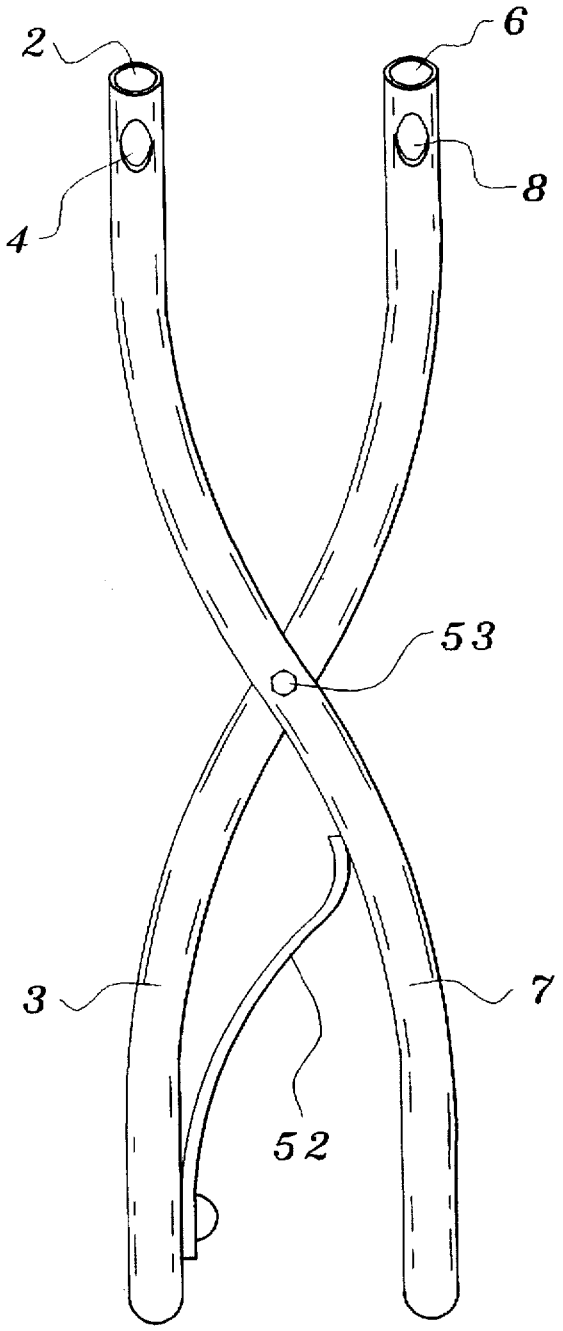
FIG. 16 shows an alternate embodiment of the invention using a pivot and spring to alternately reverse the position of the arms of the braiding apparatus.

The method of braiding artificial hair with natural hair just described may be improved if the artificial hair is firmly locked with the natural hair, so that it will not slide off. This may be done as shown in FIG. 15. A strand of artificial hair 18 is inserted into the braiding apparatus 1. Again, either of the above-described embodiments may be used, and the following description is intended to encompass both. The arms 3 and 7 are crossed to form a first loop 42 around a first natural hair strand 40. A second natural hair strand 41 is then pulled through the opening defined by the left and right portions of strand 18, and the arms 3 and 7 of the braiding apparatus. The arms 3 and 7 are then uncrossed, creating loop 43 around second natural hair strand 41. Natural hair strands 40 and 41 are then joined, creating a third strand 44. The third strand 44 is now the middle strand in the braiding process described previously, and braiding may now continue as described previously.

The present invention can also be used to braid hair in the "cornrow" style. In this style, all or most of the hair of the head is braided in relatively small braids. However, after each cycle of braiding, another small strand of hair is grasped and joined with one of the other strands of the braid, usually the middle strand. This creates a braid which follows the contour of the head, supported therefrom by the additional small strands of hair joined to the selected strand after each cycle of braiding. Both the preferred embodiment and the alternate embodiment disclosed above may be used to braid hair in the cornrow style. The only difference from the methods disclosed above is that an additional small strand of hair is joined with the selected strand after each cycle of braiding, using either of the embodiments described above.

The reader will see that the need for a mechanically simple hair braiding apparatus has been attained by the present invention, as described above. Since certain changes could be made in the embodiment of the invention described above without departing from the spirit and scope of the invention, I intend that all matter contained in the foregoing description and drawings shall be interpreted as illustrative and not in a limiting sense. The reader should understand that the following claims are intended to cover all of the generic and specific features of the invention herein described and all statements of the scope of the invention which might be interpreted to fall between these features.

I claim:

1. An apparatus for braiding hair, comprising:

(a) a rod, the rod having a U-shape, the rod having a left arm and a right arm, the arms offset from one another relative to the plane of the U-shape;

(b) guiding means for holding a first strand of hair and a second strand of hair in alignment with the left arm and the right arm, respectively;

(c) clamp means for holding the first strand of hair in slideable engagement with the left arm of the rod;

(d) clamp means for holding the second strand of hair in slideable engagement with the right arm of the rod;

(e) means for alternately reversing the positions of the left arm and the right arm;

so that the first strand, the second strand, and a third strand of hair may be braided together by alternately reversing the left and right arms of the rod while the third strand is alternately pulled upward and downward by the operator.

2. The apparatus of claim 1 where the means for alternately reversing the left and right arms of the rod comprises the U-shaped rod; the rod having a base; the base having sufficient flexibility and resiliency to permit the crossing and uncrossing of the rod when manipulated by hand.

3. The apparatus of claim 1 where the means for alternately reversing the left and right arms of the rod comprises:

(a) a pivot connecting the left and right arms of the rod, and;

(b) a spring disposed between the left and right arms, the spring applying a force holding the left and right arms of the rod normally open.

4. The apparatus of claim 1 above where the guiding means comprises, for each of the left and right arms, each arm having:

(a) an inlet hole; and, (b) an outlet hole;

the inlet hole and the outlet hole being in communication so as to form a passage for a strand of hair.

5. The apparatus of claim 1 above where the guiding means comprises, for each of the left and right arms, each arm having:

(a) a longitudinal groove, and (b) a clip sized to removably fit over each arm, the clip being rotatable around the arm, so that the grooves each form a passage for a strand of hair, and each strand of hair is held in the respective groove by the respective clip, when the clip is rotated to cover the groove.

6. The apparatus of claim 1 where the means for alternately reversing the positions of the left and right arms comprises the U-shaped rod; the rod having a base; the rod having a handle attached to the base and projecting downward therefrom; the handle having a longitudinal axis; so that the first strand, the second strand, and a third strand of hair, may be braided together by alternately turning the left and right arms of the rod about the longitudinal axis of the handle while the third strand is alternately pulled upward and downward by the operator.

7. The apparatus of claim 6 above, where the left and right arms of the rod bear directional markings, one side of the arms bearing markings both in one sense, and the opposite side of the arms bearing markings in the opposite sense.

8. The apparatus of claim 6 where the guiding means comprises, for each of the left and right arms, each arm having:

(a) an inlet hole; and, (b) an outlet hole;

the inlet hole and the outlet hole being in communication so as to form a passage for a strand of hair.

9. The apparatus of claim 6 above where the guiding means comprises, for each of the left and right arms, each arm having:

(a) a longitudinal groove, and (b) a clip sized to removably fit over each arm, the clip being rotatable around the arm, so that the grooves each form a passage for a strand of hair, and each strand of hair is held in the respective groove by the respective clip, when the clip is rotated to cover the groove.

10. A method of using an apparatus for braiding hair, having:

(a) a rod, the rod having a U-shape, the rod having a left arm and a right arm, the arms offset from one another relative to the plane of the U-shape;

(b) guiding means for holding a first strand of hair and a second strand of hair in alignment with the left arm and the right arm, respectively;

(c) clamp means for holding the first strand of hair in slideable engagement with the left arm of the rod;

(d) clamp means for holding the second strand of hair in slideable engagement with the right arm of the rod; and, (e) means for alternately reversing the positions of the left arm and the right arm;

the method comprising the steps of:

(a) separating the hair to be braided into approximately equally sized left, middle and right strands;

(b) inserting the left strand through the guiding means of one arm of the hair braiding apparatus;

(c) inserting the right strand through the guiding means of the other arm of the hair braiding apparatus;

(d) adjusting the clamp means of the hair braiding apparatus so that the left and right strands are held in slideable engagement with the arms of the hair braiding apparatus;

(e) pulling both left and right strands through the respective guiding means in the arms of the hair braiding apparatus until approximately 2.5 cm (1 inch) of hair is available between the head of the subject and the hair braiding apparatus;

(f) applying hand pressure to the arms of the hair braiding apparatus so that the arms of the hair braiding apparatus cross each other, carrying the left and right strands with the arms through which the strands are pulled;

(g) pushing the hair braiding apparatus upward and pulling the middle strand downward through the opening defined by the arms of the hair braiding apparatus and the left and right strands;

(h) relaxing hand pressure so that the arms of the hair braiding apparatus uncross;

(i) pulling the middle strand upward through the opening defined by the arms of the hair braiding apparatus and the left and right strands;

(j) applying hand pressure to the arms of the hair braiding apparatus so that the arms of the hair braiding apparatus cross each other, carrying the left and right strands with the arms through which the strands are pulled;

(k) pushing the braiding apparatus upward and pulling the middle strand downward through the opening defined by the arms of the hair braiding apparatus and the left and right strands;

(l) relaxing hand pressure so that the arms of the hair braiding apparatus uncross;

(m) repeating steps (i) through (l) above as desired while allowing the left and right strands to slide through the clamp means under tension as the braid advances.

11. A method of using an apparatus for braiding hair, having:

(a) a rod, the rod having a U-shape, the rod having a left arm and a right arm, the arms offset from one another relative to the plane of the U-shape;

(b) guiding means for holding a first strand of hair and a second strand of hair in alignment with the left arm and the right arm, respectively;

(c) clamp means for holding the first strand of hair in slideable engagement with the left arm of the rod;

(d) clamp means for holding the second strand of hair in slideable engagement with the right arm of the rod; and, (e) a means for alternately reversing the positions of the left arm and the right arm; the means comprising the U-shaped rod; the rod having a base; the rod having a handle attached to the base and projecting downward therefrom; the handle having a longitudinal axis;

the method comprising the steps of:

(a) separating the hair to be braided into approximately equally sized left, middle and right strands;

(b) inserting the left strand through the guiding means of one arm of the hair braiding apparatus;

(c) inserting the right strand through the guiding means of the other arm of the hair braiding apparatus;

(d) adjusting the clamp means of the hair braiding apparatus so that the left and right strands are held in slideable engagement with the arms of the hair braiding apparatus;

(e) pulling both left and right strands through the respective guiding means in the arms of the hair braiding apparatus as claimed, until approximately 2.5 cm (1 inch) of hair is available between the head of the subject and the hair braiding apparatus;

(f) rotating the hair braiding apparatus about the axis of the handle 180 degrees in a predetermined direction;

(g) pushing the hair braiding apparatus upward and pulling the middle strand downward through the opening defined by the arms of the hair braiding apparatus and the left and right strands;

(h) rotating the hair braiding apparatus about the axis of the handle 180 degrees in a direction opposite to that in step (f) above;

(i) pulling the middle strand upward through the opening defined by the arms of the hair braiding apparatus and the left and right strands;

(j) rotating the hair braiding apparatus about the axis of the handle 180 degrees in a direction opposite to that in step (h) above;

(k) pushing the braiding apparatus upward and pulling the middle strand downward through the opening defined by the arms of the hair braiding apparatus and the left and right strands;

(l) rotating the hair braiding apparatus about the axis of the handle 180 degrees in a direction opposite to that in step (j) above;

(m) repeating steps (i) through (l) above as desired while allowing the left and right strands to slide through the clamp means under tension as the braid advances.

12. A method of using a hair braiding apparatus for braiding hair with a strand of artificial hair, having:

(a) a rod, the rod having a U-shape, the rod having a left arm and a right arm, the arms offset from one another relative to the plane of the U-shape;

(b) guiding means for holding a first strand of hair and a second strand of hair in alignment with the left arm and the right arm, respectively;

(c) clamp means for holding the first strand of hair in slideable engagement with the left arm of the rod;

(d) clamp means for holding the second strand of hair in slideable engagement with the right arm of the rod; and, (e) means for alternately reversing the positions of the left arm and the right arm;

the method comprising the steps of:

(a) pulling a strand of artificial hair through the left and right guiding means, respectively, of the hair braiding apparatus;

(b) adjusting the clamp means of the hair braiding apparatus so that the left and right portions of the strand of artificial hair are held in slideable engagement with the arms of the hair braiding apparatus;

(c) disposing a strand of natural hair beneath the strand of artificial hair in the space defined by the left and right arms of the braiding apparatus and the strand of artificial hair;

(d) applying hand pressure to the arms of the hair braiding apparatus so that the arms of the hair braiding apparatus cross each other, carrying the left and right portions of the strand of artificial hair with the arms through which the portions are pulled, so as to form a loop in the strand of artificial hair, and thereby enclosing the strand of natural hair;

(e) pushing the hair braiding apparatus upward and pulling the middle strand downward through the opening defined by the arms of the hair braiding apparatus and the left and right strands;

(f) relaxing hand pressure so that the arms of the hair braiding apparatus uncross;

(g) pulling the middle strand upward through the opening defined by the arms of the hair braiding apparatus and the left and right strands;

(h) applying hand pressure to the arms of the hair braiding apparatus so that the arms of the hair braiding apparatus cross each other, carrying the left and right strands with the arms through which the strands are pulled;

(i) pushing the braiding apparatus upward and pulling the middle strand downward through the opening defined by the arms of the hair braiding apparatus and the left and right strands of hair;

(j) relaxing hand pressure so that the arms of the hair braiding apparatus uncross;

(k) repeating steps (g) through (j) above as desired while allowing the left and right strands to slide through the clamp means under tension as the braid advances.

13. A method of using an apparatus for braiding hair with a strand of artificial hair, having:

(a) a rod, the rod having a U-shape, the rod having a left arm and a right arm, the arms offset from one another relative to the plane of the U-shape (b) guiding means for holding a first strand of hair and a second strand of hair in alignment with the left arm and the right arm, respectively;

(c) clamp means for holding the first strand of hair in slideable engagement with the left arm of the rod;

(d) clamp means for holding the second strand of hair in slideable engagement with the right arm of the rod; and, (e) a means for alternately reversing the positions of the left arm and the right arm; the means comprising the U-shaped rod; the rod having a base; the rod having a handle attached to the base and projecting downward therefrom; the handle having a longitudinal axis;

the method comprising the steps of:

(a) pulling a strand of artificial hair through the left and right guiding means, respectively, of the hair braiding apparatus;

(b) adjusting the clamp means of the hair braiding apparatus so that the left and right portions of the strand of artificial hair are held in slideable engagement with the arms of the hair braiding apparatus;

(c) disposing a strand of natural hair beneath the strand of artificial hair in the space defined by the left and right arms of the braiding apparatus and the strand of artificial hair;

(d) rotating the hair braiding apparatus about the axis of the handle 180 degrees in a predetermined direction, so as to form a loop in the strand of artificial hair, and thereby enclosing the strand of natural hair;

(e) pushing the hair braiding apparatus upward and pulling the middle strand downward through the opening defined by the arms of the hair braiding apparatus and the left and right strands;

(f) rotating the hair braiding apparatus about the axis of the handle 180 degrees in a direction opposite to that in step (d) above;

(g) pulling the middle strand upward through the opening defined by the arms of the hair braiding apparatus and the left and right strands;

(h) rotating the hair braiding apparatus about the axis of the handle 180 degrees in a direction opposite to that in step (f) above, thereby carrying the left and right strands with the arms through which the strands are pulled;

(i) pushing the braiding apparatus upward and pulling the middle strand downward through the opening defined by the arms of the hair braiding apparatus and the left and right strands of hair;

(j) rotating the hair braiding apparatus about the axis of the handle 180 degrees in a direction opposite to that in step (h) above;

(k) repeating steps (g) through (j) above as desired while allowing the left and right strands to slide through the clamp means under tension as the braid advances.

14. A method of using an apparatus for braiding hair with a strand of artificial hair while locking the artificial hair in place with the natural hair, having (a) a rod, the rod having a U-shape, the rod having a left arm and a right arm, the arms offset from one another relative to the plane of the U-shape;

(b) guiding means for holding a first strand of hair and a second strand of hair in alignment with the left arm and the right arm, respectively;

(c) clamp means for holding the first strand of hair in slideable engagement with the left arm of the rod;

(d) clamp means for holding the second strand of hair in slideable engagement with the right arm of the rod; and, (e) means for alternately reversing the positions of the left arm and the right arm;

the method comprising the steps of:

(a) pulling a strand of artificial hair through the left and right guiding means, respectively, of the hair braiding apparatus;

(b) adjusting the clamp means of the hair braiding apparatus so that the left and right portions of the strand of artificial hair are held in slideable engagement with the arms of the hair braiding apparatus;

(c) disposing a first strand of natural hair beneath the strand of artificial hair in the space defined by the left and right arms of the braiding apparatus and the strand of artificial hair;

(d) applying hand pressure to the arms of the hair braiding apparatus so that the arms of the hair braiding apparatus cross each other, carrying the left and right portions of the strand of artificial hair with the arms through which the portions are pulled, so as to form a loop in the strand of artificial hair, and thereby enclosing the first strand of natural hair;

(e) relaxing hand pressure so that the arms of the hair braiding apparatus uncross, thereby forming a second loop in the strand of artificial hair;

(f) pulling a second strand of natural hair through the loop formed in step (e) above;

(g) joining the first and second strands of natural hair to form a middle strand;

(h) pushing the hair braiding apparatus upward and pulling the middle strand downward through the opening defined by the arms of the hair braiding apparatus and the left and right strands;

(i) applying hand pressure to the arms of the hair braiding apparatus so that the arms of the hair braiding apparatus cross each other, carrying the left and right strands with the arms through which the strands are pulled;

(j) pushing the braiding apparatus downward and pulling the middle strand upward from below the hair braiding apparatus through the opening defined by the arms of the hair braiding apparatus and the left and right strands of hair;

(k) relaxing hand pressure so that the arms of the hair braiding apparatus uncross;

(l) repeating steps (h) through (k) above as desired while allowing the left and right strands to slide through the clamp means under tension as the braid advances.

15. A method of using an apparatus for braiding hair with a strand of artificial hair while locking the artificial hair in place with the natural hair, having (a) a rod, the rod having a U-shape, the rod having a left arm and a right arm, the arms offset from one another relative to the plane of the U-shape;

(b) guiding means for holding a first strand of hair and a second strand of hair in alignment with the left arm and the right arm, respectively;

(c) clamp means for holding the first strand of hair in slideable engagement with the left arm of the rod;

(d) clamp means for holding the second strand of hair in slideable engagement with the right arm of the rod; and, (e) a means for alternately reversing the positions of the left arm and the right arm; the means comprising the U-shaped rod: the rod having a base; the rod having a handle attached to the base and projecting downward therefrom; the handle having a longitudinal axis;

the method comprising the steps of:

(a) pulling a strand of artificial hair through the left and right guiding means, respectively, of the hair braiding apparatus;

(b) adjusting the clamp means of the hair braiding apparatus so that the left and right portions of the strand of artificial hair are held in slideable engagement with the arms of the hair braiding apparatus;

(c) disposing a first strand of natural hair beneath the strand of artificial hair in the space defined by the left and right arms of the braiding apparatus and the strand of artificial hair;

(d) rotating the hair braiding apparatus about the axis of the handle 180 degrees in a predetermined direction, so as to form a loop in the strand of artificial hair, and thereby enclosing the first strand of natural hair;

(e) rotating the hair braiding apparatus about the axis of the handle 180 degrees in a direction opposite to that in step (d) above;

(f) pulling a second strand of natural hair through the loop formed in step (e) above;

(g) joining the first and second strands of natural hair to form a middle strand;

(h) pushing the braiding apparatus upward and pulling the middle strand downward through the opening defined by the arms of the hair braiding apparatus and the left and right strands;

(i) rotating the hair braiding apparatus about the axis of the handle 180 degrees in a direction opposite to that in step (f) above, thereby carrying the left and right strands with the arms through which the strands are pulled;

(j) pushing the braiding apparatus downward and pulling the middle strand upward through the opening defined by the arms of the hair braiding apparatus and the left and right strands of hair;

(k) rotating the hair braiding apparatus about the axis of the handle 180 degrees in a direction opposite to that in step (i) above;

(l) repeating steps (h) through (k) above as desired while allowing the left and right strands to slide through the clamp means under tension as the braid advances.

16. A method of using an apparatus for braiding hair in the cornrow style, having:

(a) a rod, the rod having a U-shape, the rod having a left arm and a right arm, the arms offset from one another relative to the plane of the U-shape;

(b) guiding means for holding a first strand of hair and a second strand of hair in alignment with the left arm and the right arm, respectively;

(c) clamp means for holding the first strand of hair in slideable engagement with the left arm of the rod;

(d) clamp means for holding the second strand of hair in slideable engagement with the right arm of the rod; and, (e) means for alternately reversing the positions of the left arm and the right arm;

the method comprising the steps of:

(a) separating the hair to be braided into approximately equally sized left, middle and right strands;

(b) inserting the left strand through the guiding means of one arm of the hair braiding apparatus;

(c) inserting the right strand through the guiding means of the other arm of the hair braiding apparatus;

(d) adjusting the clamp means of the hair braiding apparatus so that the left and right strands are held in slideable engagement with the arms of the hair braiding apparatus;

(e) pulling both left and right strands through the respective guiding means in the arms of the hair braiding apparatus until approximately 2.5 cm (1 inch) of hair is available between the head of the subject and the hair braiding apparatus;

(f) applying hand pressure to the arms of the hair braiding apparatus so that the arms of the hair braiding apparatus cross each other, carrying the left and right strands with the arms through which the strands are pulled;

(g) pushing the hair braiding apparatus upward and pulling the middle strand downward through the opening defined by the arms of the hair braiding apparatus and the left and right strands;

(h) relaxing hand pressure so that the arms of the hair braiding apparatus uncross;

(i) pulling the middle strand upward through the opening defined by the arms of the hair braiding apparatus and the left and right strands;

(j) selecting one of the right, middle or left strands to be joined with a fourth strand of natural hair;

(k) pulling the fourth strand of natural hair upward through the opening defined by the arms of the hair braiding apparatus and the left and right strands, and joining the fourth strand with the selected strand;

(l) applying hand pressure to the arms of the hair braiding apparatus so that the arms of the hair braiding apparatus cross each other, carrying the left and right strands with the arms through which the strands are pulled;

(m) pushing the braiding apparatus upward and pulling the middle strand downward through the opening defined by the arms of the hair braiding apparatus and the left and right strands;

(n) relaxing hand pressure so that the arms of the hair braiding apparatus uncross;

(o) repeating steps (i) through (n) above as desired while allowing the left and right strands to slide through the clamp means under tension as the braid advances.

17. A method of using an apparatus for braiding hair in the corrrow style, having:

(a) a rod, the rod having a U-shape, the rod having a left arm and a right arm, the arms offset from one another relative to the plane of the U-shape;

(b) guiding means for holding a first strand of hair and a second strand of hair in alignment with the left arm and the right arm, respectively;

(c) clamp means for holding the first strand of hair in slideable engagement with the left arm of the rod;

(d) clamp means for holding the second strand of hair in slideable engagement with the right arm of the rod; and, (e) a means for alternately reversing the positions of the left arm and the right arm; the means comprising the U-shaped rod; the rod having a base; the rod having a handle attached to the base and projecting downward therefrom; the handle having a longitudinal axis;

the method comprising the steps of:

(a) separating the hair to be braided into approximately equally sized left, middle and right strands;

(b) inserting the left strand through the guiding means of one arm of the hair braiding apparatus;

(c) inserting the right strand through the guiding means of the other arm of the hair braiding apparatus;

(d) adjusting the clamp means of the hair braiding apparatus so that the left and right strands are held in slideable engagement with the arms of the hair braiding apparatus;

(e) pulling both left and right strands through the respective guiding means in the arms of the hair braiding apparatus until approximately 2.5 cm (1 inch) of hair is available between the head of the subject and the hair braiding apparatus;

(f) rotating the hair braiding apparatus about the axis of the handle 180 degrees in a predetermined direction;

(g) pushing the hair braiding apparatus upward and pulling the middle strand downward through the opening defined by the arms of the hair braiding apparatus and the left and right strands;

(h) rotating the hair braiding apparatus about the axis of the handle 180 degrees in a direction opposite to that in step (f) above;

(i) pulling the middle strand upward through the opening defined by the arms of the hair braiding apparatus and the left and right strands;

(j) selecting one of the right, middle or left strands to be joined with a fourth strand of natural hair;

(k) pulling the fourth strand of natural hair upward through the opening defined by the arms of the hair braiding apparatus and the left and right strands, and joining the fourth strand with the middle strand;

(l) rotating the hair braiding apparatus about the axis of the handle 180 degrees in a direction opposite to that in step (h) above;

(m) pushing the braiding apparatus upward and pulling the middle strand downward through the opening defined by the arms of the hair braiding apparatus and the left and right strands of hair;

(n) rotating the hair braiding apparatus about the axis of the handle 180 degrees in a direction opposite to that in step (l) above;

(o) repeating steps (i) through (n) above as desired while allowing the left and right strands to slide through the clamp means under tension as the braid advances.

* * * * *